US005451144A

United States Patent [19]

French

[11] Patent Number: 5,451,144

[45] Date of Patent: Sep. 19, 1995

[54] AIR-OPERATED PUMP

[76] Inventor: George F. French, 4009 Linden St., Oakland, Calif. 94608

[21] Appl. No.: 108,198

[22] Filed: Aug. 18, 1993

[51] Int. Cl.[6] ..... F04F 1/06

[52] U.S. Cl. ..... 417/131; 417/134; 417/138; 417/143; 417/145

[58] Field of Search ..... 417/39, 41, 128, 130, 417/131, 133, 134, 138, 143, 145, 146, 147

[56] References Cited

U.S. PATENT DOCUMENTS

| | | | |
|---|---|---|---|
| 3,077,163 | 2/1963 | Eyman | 417/128 |
| 3,972,650 | 8/1976 | Brennan | 417/128 |
| 4,021,147 | 5/1977 | Brekke | 417/138 |
| 4,321,017 | 3/1982 | Gottliebson | 417/128 |
| 5,074,758 | 12/1991 | McIntyre | 417/138 |
| 5,092,743 | 3/1992 | Dietrich | 417/131 |

*Primary Examiner*—Richard A. Bertsch
*Assistant Examiner*—Roland G. McAndrews, Jr.
*Attorney, Agent, or Firm*—Howard Cohen

[57] ABSTRACT

An air-operated pump includes a pair of poppet valves affixed to a vertical valve shaft and arranged so that the upper valve is closed when the lower valve is open, and vice versa. When a connected displacer is immersed in tank fluid, its buoyancy in combination with a bias spring translates the valve shaft to operate the poppet valves. An upper poppet valve chamber is connected [1] via a restrictance to an auxiliary air supply, and also [2] to an air operator that triggers a three-way pneumatic valve, an inlet port of which controls a main air supply while a second port is vented to atmosphere. A third port transmits an air supply to the tank through the intermediation of a quick exhaust valve, which rapidly vents the tank at the end of each pump cycle and also serves to isolate the three-way valve from any tank-fluid contamination. Before fluid rises to the level at which pumping begins, the upper popper stays closed and high-pressure air thus trapped in its chamber keeps the air operator of the three-way valve actuated, blocking the main air supply. When fluid reaches the critical level, the buoyancy-aided displacer and shaft-mounted popper valves are pulled up by the bias spring, and the upper poppet vents its chamber, lowering the pressure to the air operator, which triggers the three-way valve and the quick exhaust valve into closing the tank vent to atmosphere and transmitting the main air supply into the tank to initiate pumping by ejection. The lowering fluid level causes the displacer and shaft-mounted valves to drop, whereby pressure in the upper poppet chamber rises to reactuate the air operator, switching the three-way valve back to its first position, so that the air supply is cut off from the tank, and the quick exhaust valve rapidly vents the tank to atmosphere.

22 Claims, 3 Drawing Sheets

AIR-OPERATED PUMP

BACKGROUND OF THE INVENTION

There is a long history of efforts to develop and perfect air-operated pumps because they offer the promise of fluid pumping without the use of prime mover elements such as pistons, impellers, diaphragms, or other mechanical components such as are required in other forms of pumps. As a result, the advantage of air-operated pumps should consist not only in a reduction of the number of moving parts, with attendant simplification and greater reliability, but also in an enhanced ability to safely and dependably pump corrosive and noxious fluids. Many earlier pumps were endowed with so great a proliferation of moving parts that their use with non-homogeneous fluid-mixtures would lead to early failure through either increased friction or inevitable corrosion. Thus the ideal of an air-operated pump that would operate under a great variety of difficult circumstances, and would be long-lasting and free of corrosion problems, and would have an absolute minimum of moving parts, has proved elusive.

A predecessor invention, described in U.S. Pat. No. 4,467,831, issued Aug. 28, 1984, to French did accomplish many of the above objectives, particularly in that the liquid-detection mode and the pumping mode were combined in the function of a single moving part, thus achieving great simplicity and reliability in the resultant pumping system. While in the typical centrifugal pump the failure of a separate liquid-level control will doom the pump to run dry until it is either manually turned off or else it burns up, the combination in this new pump of liquid-detection with actual pumping prevented the failure mode that has long plagued electrical and air-operated centrifugal pumps.

Another feature of the predecessor pump was the fact that no energy was used until pumping was triggered and the unit began to operate. This triggering occurred when liquid had risen to that point in the chamber where the control-gate valving means finally lifted up off its valve seat to initiate pumping. In the real world, where the conservation of energy has a high priority, this non-consumption of energy when the pump is in an idle mode is of very great importance. Thus the referenced Aikman pump (U.S. Pat. No. 1,658,031) as well as compressed-air-operated centrifugal pumps, and substantially all the rest of the known prior art, constantly leaked air to a greater or lesser extent during the idle or resting portion of the pump cycle. Indeed, the chronic problem with not just pumps alone, but with fluidic devices in general, and one major reason for their lack of more general use, has been that they more or less constantly bleed off or dissipate power during the non-working or "null" part of their duty cycle.

But the prior invention suffered several serious limitations:

[1] Pumping capacity was low because the rate at which compressed air could be admitted into the pumping chamber was low (due to air-pressure-dependent valve geometry), with the result that the pump was practical only for small installations with limited pumping needs.

[2] An excessively long time was needed to vent used air out of the pumping chamber: before a new charge of liquid could be admitted by gravity, the space in the chamber above the liquid had to return to atmospheric pressure. This venting became slower as the pressure inside the chamber decreased, thus causing the air-exhaust portion of the pumping cycle to be awkwardly long and so in turn seriously limiting the pumping efficiency of any system utilizing this principle.

[3] High pumping heads were not practical (in deep wells, for example): Because of the pump's too-simple design, the pressure needed for the liquid-level detection mode, as well as the ultimately available compressed-air pumping pressure, necessarily both had to be one and the same. This meant that the greater pressures required for pumping against higher heads required tinier orifices through which air was admitted, so that the net downward force holding a valve poppet closed would not otherwise exceed such upward displacement forces as were practically attainable in the limiting geometry of well pumps.

SUMMARY OF THE INVENTION

The present invention generally comprises an improved air-operated pumping device that overcomes the limitations in the prior art enumerated above. The pump includes a tank that accumulates a charge of fluid, and a poppet valve assembly secured typically atop the tank. The valve assembly includes a valve body having typically a vertical bore that is vented to atmosphere. Such valve assembly is herewith described as comprising such a vertical bore wherein there is also a pair of poppet valves joined by a vertical valve shaft and arranged so that the upper valve is normally closed and the lower valve is normally open, "normal" here referring to the state of the valving complex when there is insufficient fluid in the tank to trigger the pumping operation. The opening of the upper valve occurs as the lower valve closes, and such opening occurs only when there is sufficient fluid in the tank to trigger the valving complex into pumping operation. A system of one or more displacement members depends from the lower poppet valve and is disposed to become immersed in fluid that has accumulated in the tank, so that any buoyancy imparted to the displacement-member system from such accumulated fluid charge, together with the force of a bias spring (arranged about the upper poppet valve to constantly exert an upward pull on the valving complex), can serve to translate the valve shaft and operate the poppet valves.

The lower poppet valve chamber is connected directly to the upper end of the tank, and the upper poppet valve chamber is connected to a restricted, typically lower-pressure air supply and to an air operator that triggers a three-way pneumatic valve. A first port to the three-way valve is the input from a connecting main air supply which has a typically higher pressure and higher flow rate. A second port is vented to atmosphere, or to vacuum (where more rapid pump cycling is desired, such as in continuous-pumping applications). A third port is connected by a first conduit to the air-inlet port of a quick exhaust valve (QEV). The QEV also has an air-exhaust port for venting the QEV either to atmosphere or to vacuum. The air-inlet port of the QEV is typically oriented downward so that an elastomeric shuttle element, arranged to move freely (within a preferably smooth-walled cylindrical bore portion of the QEV, between a normal downward position, which seals the air-inlet port, and an upward position, which seals the air-exhaust or vacuum port of the QEV during pumping operation), will thus normally seal the air-inlet port of the QEV when the pump is not operating, thus assuring that the 3-way valve remains isolated from the effects of any possibly deleterious gasses issuing from the fluid being pumped. Continuous flow communication between the QEV and the tank is provided by a second conduit that connects a third flow-port from the QEV to the air-space above any fluid charge in the tank.

When accumulating fluid reaches a predetermined high level in the tank, a consequent increase in buoyancy of the displacement-member system allows the bias spring to overwhelm the downward weight and air-pressure forces on the upper popper valve, so that the valve shaft now moves upward until the lower poppet seals the upper end of the tank, and the upper popper has opened the upper valve chamber, thus allowing the chamber to be vented to atmosphere through the vent inside the vertical bore of the valve assembly. The consequent drop in pressure at the air operator triggers the three-way valve to close its vent connection to atmosphere (or vacuum) and simultaneously open the first (inlet) port so as to transfer the main air-supply flow to the third port and then via the first conduit to the air-inlet port of the QEV. The sudden application of this air supply to the air-inlet port of the QEV causes the elastomeric shuttle element to rapidly shift from its normal downward position (which normally seals the air-inlet port) to its upward position, which serves to seal the air-exhaust or vacuum port of the QEV during pumping. At the same time, the inrushing supply air collapses inward the thin free edges of the elastomer shuttle element, much like the action of a leather cup in the classical bicycle pump. This collapsing inward allows the supply air to now pass out the always-open third port of the QEV, through the second conduit to the tank, where the thrust of the main air supply pneumatically ejects the fluid in the tank through a tank outlet check valve located at or near the lower end of the tank.

When as a result of this pneumatic ejection the fluid level in the tank has dropped to a certain low level, the displacement-member system correspondingly drops downward so as to close the upper poppet and open the lower poppet valves. Pressure quickly rises in the upper poppet chamber, which in turn triggers the air operator to switch the three-way valve. This switching closes the first (inlet) port of the three-way valve, shutting off the main air supply, and at the same time vents the third port to atmosphere (or to vacuum) so that any air in the first conduit is exhausted. Because the air pressure in the tank is still at a high level, this venting to atmosphere (or to vacuum) of the first conduit creates a sudden pressure differential across the shuttle element, causing it to very rapidly move toward and seal off the air-inlet port of the QEV, while simultaneously opening the QEV's previously closed-off larger vent to atmosphere (or to vacuum). The opening of this larger vent now allows the tank to rapidly exhaust its compressed-air charge so that the system in effect quickly resets itself and permits the tank to fill once again with fluid so as to repeat the pumping cycle described above (the vent to vacuum will cause the reset to take place even more quickly). It is important to note that the shuttle element is specially shaped, typically like the leather cup in a bicycle pump, so that such shape will by the frictional contact action of its edge tend to hold the shuttle element sealed against both the straight-bore cylindrical walls of the QEV chamber as well as against the air-inlet port of the QEV, thus assuring continued isolation of the three-way valve from potentially deleterious gasses issuing from fluid in the tank. It is this same frictional contact action of the shuttle element's edge that allows the high-pressure air in the tank (coming into the QEV through the third port of the QEV) to so effectively translate the shuttle element when the first conduit is vented to atmosphere (or to vacuum).

The present invention now not only serves to incorporate the predecessor invention's earlier-noted advantages, but also addresses its limitations as follows:

[1] Any pumping capacity is now possible because the rate at which compressed air is admitted into the tank is determined by a kind of pneumatic-relay function that is independent of the air flow rate through the poppet valves. Thus the pumping rate will depend only on the design needs of a given engineered system.

[2] The time needed for exhausting used air has now been greatly shortened, reducing the cycle time and increasing the net pumping efficiency of the system.

[3] A greater range of pumping heads is now practical: the fluid-level detection means is separated from the pumping means, whereby the compressed-air pressure needed for the fluid-level detection means may now be separately regulated (to match the special needs of a particular system) so as to create a significantly greater range of applications for this new kind of pumping system; e.g., for a given well-pump geometry, one may now pump against significantly higher heads.

The dependability and reliability of this new kind of pumping system is moreover greatly improved due to

[1] the effective isolation of the air-operated three-way valve from the fluid being pumped, whereby because of the intermediation of the quick exhaust valve, no part of the mechanism of said valve is exposed to the often corrosive effects of such liquids; and

[2] the fact that compressed-air serves to effectively purge the fluid passages and airways of foreign matter during each pumping cycle.

DESCRIPTION OF THE PREFERRED EMBODIMENT

Figure 1:
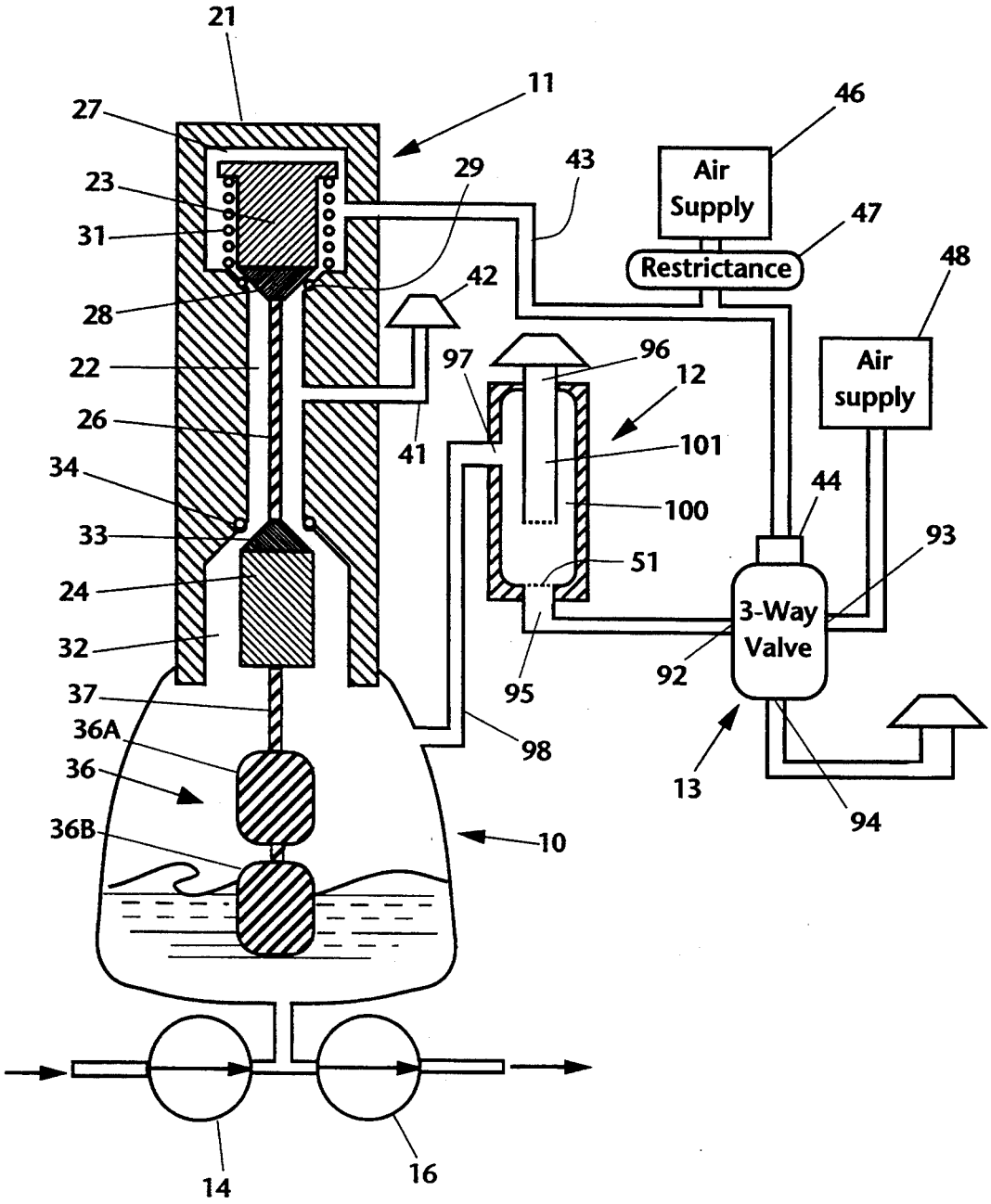
FIG. 1 is a functional depiction of a typical pumping arrangement of the present invention, using gravity alone to fill the tank with fluid.

The present invention generally comprises an improved air-operated pump that provides a high pumping rate, high pumping head, and reduced cycle time. With regard to FIG. 1, the invention generally includes a tank 10 for accumulating fluid, a fluid level sensing valve arrangement 11, a quick exhaust valve 12, and a multi-port air-operated valve 13. The tank 10 may comprise a sump accumulator, a sewage tank, a sealed-end pipe vessel disposed at the bottom of a borehole, or indeed any shape or geometry convenient to the application. An inlet check valve 14 permits fluid to flow into the tank 10 under gravitational pressure, and an outlet check valve 16 directs the output of the tank 10 to a desired recovery pipe, tank, pond, reservoir, or the like.

The valve arrangement 11 includes a valve body 21 having a vertical bore 22, and a pair of poppet valves 23 and 24 joined by a vertical valve shaft 26. The upper poppet valve 23 is disposed within a valve chamber 27, and a valve surface 28 is disposed to seat on an elastomeric ring 29. A compression spring 31 is arranged to bias poppet 23 upwardly toward an open disposition. The lower poppet 24 is disposed in a chamber 32, which opens directly to the interior of the tank 10, and also includes a valve surface 33 disposed to seat on ring 34. Valve surfaces 28 and 33 are typically and conveniently conical (e.g., to help assure that the valving assembly will stay centered in the bore 22), but the valve surfaces may in some applications be preferably flat, and other geometries are also possible.

A displacement-member system 36 consists of one or more displacers (36*a*, 36*b*, . . . ) and depends from the lower popper valve 24 by a connecting rod or cable 37. The shaft 26 is dimensioned with respect to the length of the bore 22 so that the upper poppet valve 23 is already open when the lower poppet valve 24 closes. A conduit 41 connects the bore 22 to atmospheric vent 42. When the displacement-member system 36 is immersed to a sufficient depth, the resultant upward buoyant force on the displacement-member system, and the bias force of the spring 31, act in concert to overcome the combined weight of the assembly and the downward force on upper poppet 23 (which results from the air pressure in chamber 27 operating over the area of seat 29), so that on net the valve shaft 26 is translated upwardly so as to cause a shifting of the poppet-valve positions.

Upper valve chamber 27 is connected by conduit 43 to an air operator 44, which is operatively connected to actuate three-way valve 13. Air supply 46 is connected through restrictance 47 to the conduit 43, so as to supply the conduit with pressurized air at a low flow rate. Valve 13 includes air-inlet port 93, which is connected to a high-pressure, high-flow air supply 48. Port 94 of valve 13 is vented to atmosphere, and port 92 is connected to air-inlet port 95 of quick exhaust valve 12 via conduit 91. Valve 13 is nominally a "normally-open" type; i.e., it is arranged so that port 93 is blocked when there is a relatively low (or no) pressure at operator 44, and port 92 is simultaneously vented to atmosphere through port 94.

Quick exhaust valve (QEV) 12 includes air-inlet port 95, connected to port 92 of valve 13, and port 97, which is connected directly to the upper portion of the interior of the tank 10. Port 96 of valve 12 is vented to atmosphere. Port 97 of valve 12 is always connected in free flow communication with tank 10. A cup-shaped elastomer shuttle element 51 is laterally constrained at its oblique flange edges to move only vertically within the smooth-walled interior bore 100 of valve 12. Coaxially arranged within an annular portion of the bore 100, and projecting downwardly toward port 95, is a cylindrical projection or neck 101, which is attached to the body of valve 12 and connected to the port 96. At the lower end of the neck 101 is a perforated surface arranged to receive and support the upper side of shuttle element 51, when pressure differentials force element 51 against said perforated surface. A short distance below the perforated end surface of neck 101 is another such surface, adjunct to port 95, to receive the lower side of shuttle element 51, when pressure differentials force element 51 against said perforated surface. Shuttle element 51 is constructed so that a high volume flow into the QEV from port 95 will first thrust the shuttle element against the perforated end surface of neck 101 (sealing the port 96), and then secondarily a higher air pressure on the air-inlet side of the shuttle element will then force the oblique flange portion of the shuttle element to collapse inwardly, thus permitting substantial air flow from air-inlet port 95 through to port 97 and then on to the tank 10. Alternately, when conduit 91 is evacuated and there is still a higher pressure inside tank 10, the resultant reverse pressure differential across shuttle element 51 will immediately pull the shuttle element off the perforated end surface of neck 101 and push it hard into the correspondingly shaped seat immediately adjunct to port 95, thus sealing that port. This latter action is facilitated by the fact that the shuttle has been molded to normally spread its cup-shaped oblique flange snugly against the smooth interior walls of bore 100, so that no appreciable amount of leak will occur as the shuttle is thus impressed downward toward the perforated surface adjunct to port 95.

To describe the operation of the pump arrangement of the invention, it is assumed that the system is initially in a quiescent condition: i.e., the fluid inside tank 10 has not yet reached the design level at which pumping will automatically start. In this quescent condition, which is illustrated in FIG. 1, poppet valve 23 is closed and poppet valve 24 is open. The pressure in valve chamber 27 is the same as that of conduit 43, air operator 44 and the air supply 46. The pressure differential between the valve chamber 27 and the vented bore 22 creates a pneumatic valve force that aids in holding the poppet 23 closed. Pressure in line 43 also keeps the air operator 44 of valve 13 actuated so that air-inlet port 93 is blocked and port 92 is vented to atmosphere through port 94. Shuttle element 51, which had been forced down against the perforated surface adjunct to the QEV's air-inlet port 95 by the thrust of exhaust-air discharge at the end of the preceding pump cycle, now remains in place (thanks to both gravity and the frictional drag of the shuttle's flange edges against the bore walls of chamber 100), effectively sealing air-inlet port 95, and therefore isolating valve 13 from the potentially damaging effect of gasses emitted from fluids in tank 10.

When the fluid inside tank 10 reaches the design level at which pumping is supposed to start, the buoyant force of the displacement-member system 36, combined with the upward bias force of spring 31, together overcome the downward "pneumatic-valve force"0 and the weight of the valving assembly, and as a result, the valve assembly is translated upwardly, opening poppet valve 23 and closing poppet valve 24. The upper valve chamber 27 is thus vented through bore 22 and line 41 to atmosphere, and the tank volume is sealed by poppet 24. The pressure in line 43 drops, deactuating the air operator so that inlet port 93 now opens to allow high-pressure, high-volume air to flow from supply 48 through port 92 and onward via conduit 91 to the valve 12. This inrush of air into the QEV (valve 12) now thrusts shuttle element 51 upward off the perforated surface (adjunct to port 95) and immediately up against the opposing similar perforated surface at the bottom end of neck 101 (adjunct to port 96). Simultaneously, the pressure differential upward across the shuttle element causes the flange edges of the shuttle to collapse inwardly, with the consequence that supply air now rushes on through the QEV and into tank 10, where pressure rises quickly, ejecting the fluid therein out through check valve 16. The shuttle element remains pinned against the perforated surface at the bottom end of neck 101 because of the differential in pressure between the chamber 100 and the atmospheric pressure connecting to port 96.

The ejection action continues until the fluid level in the tank falls substantially, and ultimately the weight of the displacement-member system overcomes the bias force of spring 31 and the valve assembly translates downwardly. Valve 23 then closes and valve 24 opens once again, and the closure of valve 23 causes the pressure in line 43 to rise, triggering air operator 44 to again actuate valve 13, so that high-pressure air from supply 48 is blocked, and conduit 91 is at the same time vented to atmosphere. Now the pressure differential across the shuttle element 51 is suddenly reversed because there is still a high pressure inside both tank 10 and the QEV's chamber 100, whereas the pressure at port 95 has dropped to atmospheric—and this pressure reversal now thrusts the shuttle back down against the perforated surface adjunct to port 95, whereupon the air charge in tank 10 can now freely and rapidly flow out of the tank through the just-opened exhaust vent at the lower end of neck 101, permitting the tank to rapidly return to atmospheric pressure. Thus the time required to depressurize the tank is minimized, and the tank is set once again to fill with fluid and initiate another pumping cycle.

Figure 2:
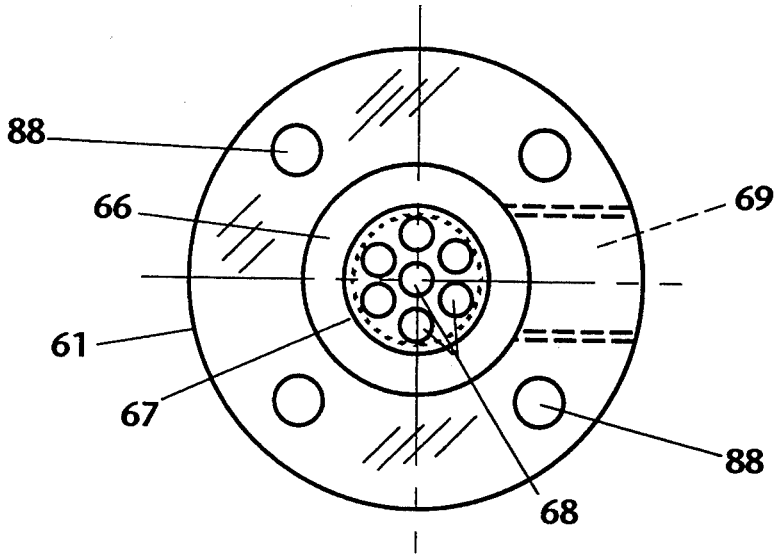
FIG. 2 is a bottom end view of the upper member of a preferred form of the quick exhaust valve as incorporated into the present invention.
Figure 3:
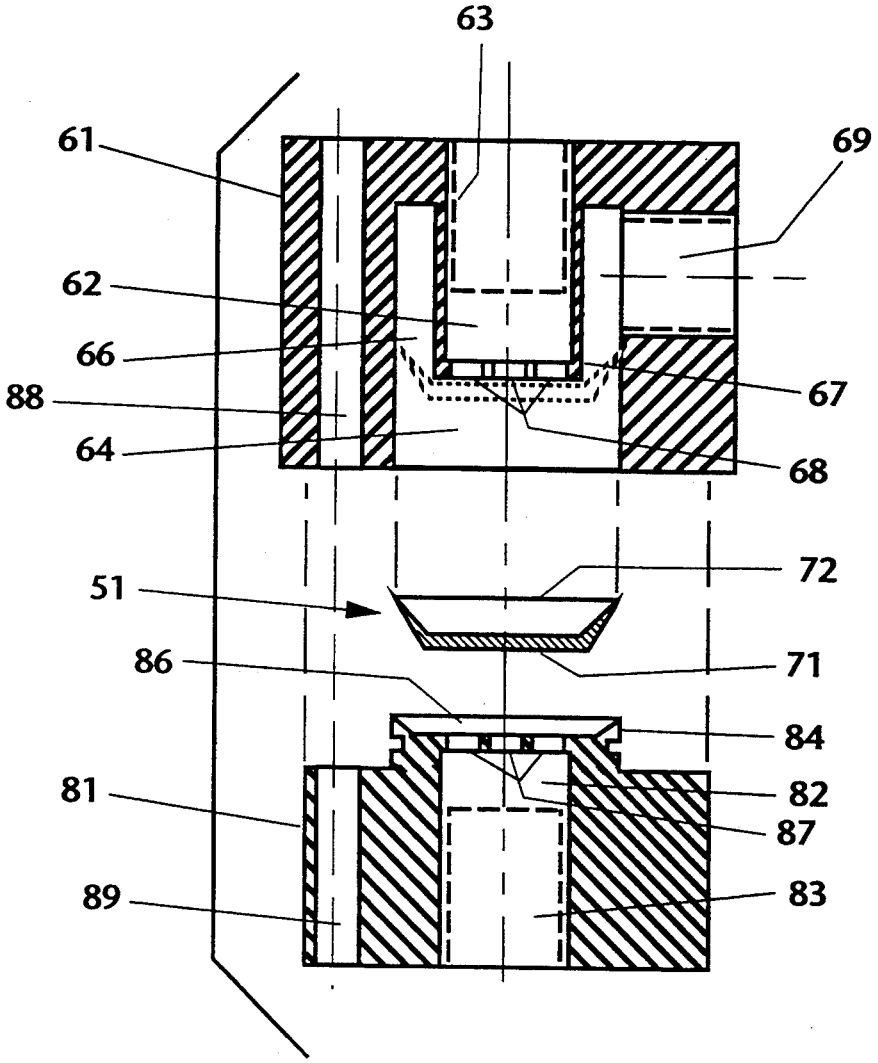
FIG. 3 is a cross-sectional exploded view of the upper and lower members, and of the movable shuttle element, of the quick exhaust valve as incorporated into a preferred form of the present invention.

With regard to FIGS. 2 and 3, a preferred embodiment of the quick exhaust valve 12 includes a valve body 61 having a generally cylindrical shape. The body 61 includes an upper bore 62 extending coaxially in the upper end and provided with a threaded portion 63. A lower bore 64 extends coaxially in the lower end of the body, and includes an inner annular portion 66 which defines a cylindrical projection 67 extending downwardly. A portion of the upper bore 62 extends into the projection 67, and a plurality of holes 68 in the lower end of the projection 67 join the upper and lower bores in flow communication. A tapped hole 69 extends radially in the body 61 from the exterior to the annular space 66, and comprises valve port 97 described previously. Valve port 96 comprises the tapped upper bore 62.

The shuttle valve element 51 comprises a disc 71 having an annular flange 72 extending obliquely upwardly from the plane of the disc. The disc has a diameter sufficient to cover the end of the projection 67 in sealing fashion, and the diameter of the flange 72 is substantially similar to the diameter of the lower bore 64. Thus the shuttle element 51 is frictionally engaged in the bore 64, and is capable of translation under motive force provided by pressure differential across the shuttle element 51. For example, air flow from the tapped hole 69 will urge the disk 71 downwardly in the bore 64, opening the flow path through holes 68 to the port 62 and thence to atmospheric vent. On the other hand, air flow introduced into the port 95 will urge the disc 71 upwardly in the bore 64 to seal the openings 68, as shown in broken line in FIG. 3. The shuttle valve element 51 is formed of a resilient elastomer that permits substantial flexure of the flange 72, so that pressure introduced into the lower end of the bore 64 can deflect the flange 72 and flow thereby toward the tapped port 69.

The valve 12 also includes an end cap 81, comprising a cylindrical body having a cylindrical neck 84 extending coaxially from the upper end thereof. A bore 82 extends coaxially into the lower end of the end cap 81, and is provided with a tapped portion 83 which comprises the port 95 described previously. The neck is dimensioned to provide an O-ring sealed fit (per the O-ring groove 90) within the lower bore 64, and the upper surface of the neck is provided with a cup-like receptacle 86 dimensioned to snugly receive the shuttle valve element 51 so as to thus facilitate sealing the adjunct air-inlet port from any gasses possibly present inside the QEV because of its free communication with tank 10. A plurality of holes 87 extend from the bore 82 to the receptacle 86 to provide flow communication from the bore 82 to the opposing bore 64. A plurality of holes 88 and 89 in the valve body and end cap, respectively, are provided so that these two components may be joined coaxially, as shown in FIG. 3, and secured by appropriate bolts and nuts.

Figure 4:
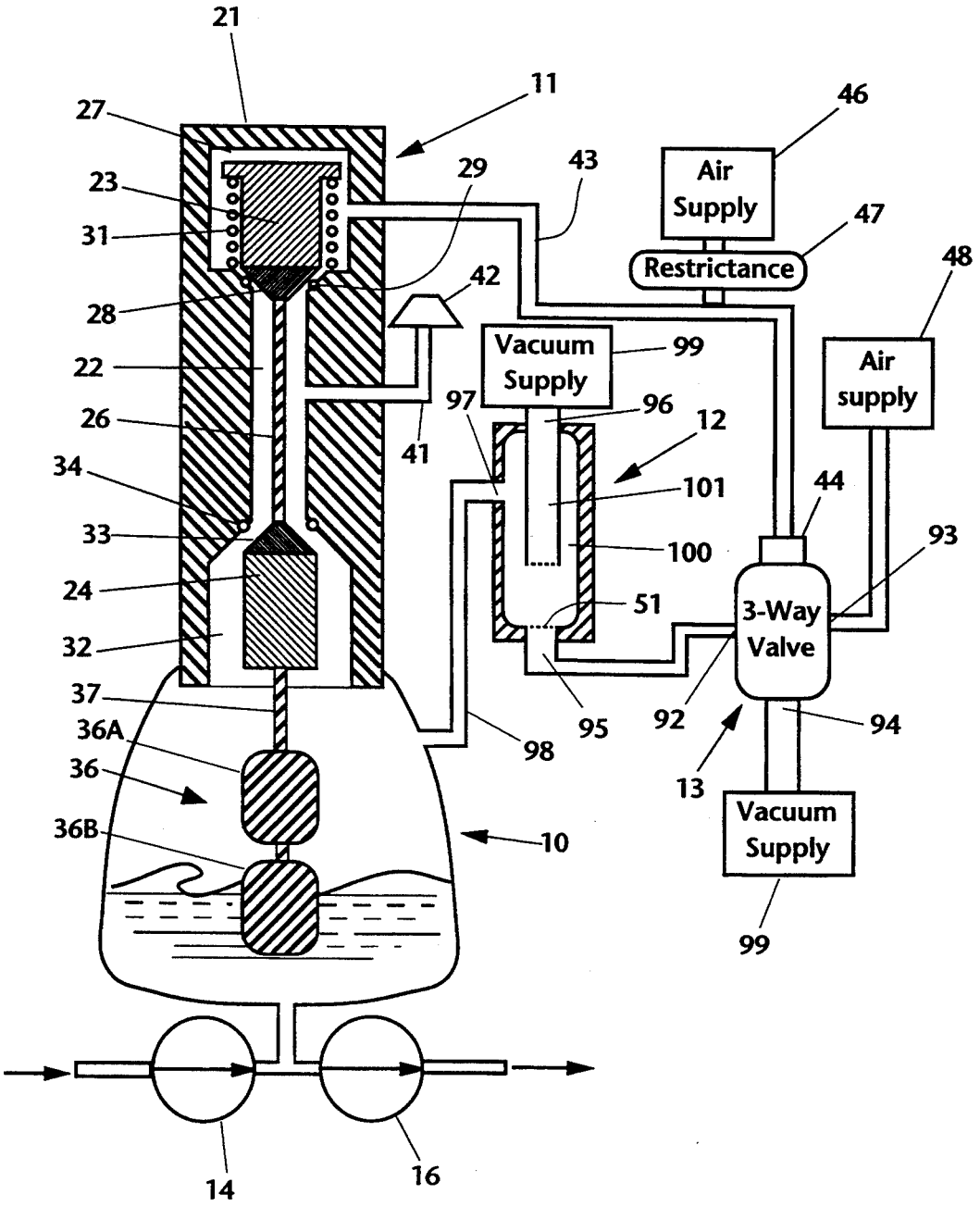
FIG. 4 is a functional depiction of a typical pumping arrangement of the present invention, using vacuum power to increase the rate at which the tank will fill with fluid.

FIG. 4 is similar to FIG. 1 in every respect except for the vacuum supply 99 that has been substituted for the atmospheric-vent connections at port 94 of the three-way valve and at port 96 of the quick exhaust valve 12. The purpose of the vacuum connection is to increase the rate at which fluid will enter inlet check valve 14 (as opposed to the lower inflow rate under gravitational pressure alone), so that in turn the net gallons-per-minute pumping rate will be greater.

Advantages of the quick exhaust valve structure of the invention are [1] that it can be formed entirely of non-reactive material to resist the deleterious effect of gasses issuing from tank fluid; and [2] that its sole moving part, the elastomer shuttle element 51, undergoes negligibly little wear during operation of the pump. These two factors result in a valve that will require essentially no maintenance.

In addition, the pumping system as a whole is extremely reliable and dependable, due to the effective isolation of the air-operated three-way valve from the fluid being pumped, so that no part of the mechanism of the valve is exposed to the often corrosive effects of such fluids. In addition, compressed-air from both air supplies serves to effectively purge the fluid passages and airways of any foreign matter or corrosive vapors and fumes during each pumping cycle, further enhancing the longevity of the system.

Returning to FIG. 1, it should be noted that the air pressure introduced into valve chamber 27 when valve poppet 23 is closed produces a pressure differential across the poppet that creates a downward force on the poppet. This downward force (pneumatic valve force) tends to hold the valve poppet closed, so that the buoyant force of the displacer-member system 36 must also overcome the pressure differential across poppet 23. Closure of the lower poppet valve 24 during pumping similarly creates an upward pneumatic valve force that counteracts the weight of the displacement-member system 36. The pneumatic valve force generated by both poppet valves creates a latching effect in both valve positions that increases the differential between the extreme upper fluid level that triggers the valve assembly to begin the pumping cycle, and the extreme lower fluid level that stops the pumping action and resets the system.

The pressure of air supply 46 can moreover be regulated so that the pneumatic valve force can be selectively modified. This factor may be important, for example, in modifying the pumping system to accommodate fluids having specific gravities appreciably different from water. The pneumatic valve force generated from separate air supply 46 is not affected by the net operating pressure of the air supply 48, which provides pumping power only.

The foregoing description of the preferred embodiment of the invention has been presented for purposes of illustration and description. It is not intended to be exhaustive or to limit the invention to the precise form disclosed, and many modifications and variations are possible in light of the above teaching without deviating from the spirit and the scope of the invention. The embodiment described is selected to best explain the principles of the invention and its practical application to thereby enable others skilled in the art to best utilize the invention in various embodiments and with various modifications as suited to the particular purpose contemplated. It is intended that the scope of the invention be defined by the claims appended hereto.

I claim:

1. An air-operated pumping arrangement for pumping fluid from a tank, including:

first air supply means for delivering pressurized air through a first pressure line to the tank during a pumping cycle to force fluid from the tank through a tank outlet;

air-operated valve means interposed in said first pressure line to selectively connect said first air supply means to said first pressure line during a pumping cycle and to selectively connect said first pressure line to vent to atmosphere at the end of a pumping cycle;

quick exhaust valve means connected to said first pressure line between said tank and said air-operated valve means for permitting passage of said pressurized air to said tank during said pumping cycle and to rapidly exhaust said pressurized air from said tank at the end of a pumping cycle; and poppet valve means for actuating said air-operated valve means when the tank is filled by fluid to a predetermined level and for sealing the tank during said pumping cycle.

2. The air-operated pumping arrangement of claim 1, wherein said air-operated valve means includes an air operator connected to actuate a three-port pneumatic valve.

3. The air-operated pumping arrangement of claim 2, further including a second pressure line connected between said poppet valve means and said air operator, and second air supply means connected to said second pressure line.

4. The air-operated pumping arrangement of claim 3, wherein said poppet valve means includes a first poppet disposed in a first valve chamber, said second pressure line connected to said first valve chamber.

5. The air-operated pumping arrangement of claim 4, wherein said poppet valve means includes a second poppet valve disposed in a second valve chamber, said second valve chamber connected directly to an upper portion of the interior of the tank.

6. The air-operated pumping arrangement of claim 5, further including a bore connecting said first and second valve chambers, said bore extending generally vertically, and valve shaft means extending in said bore for connecting said first and second poppers so that said first poppet opens as said second poppet closes.

7. The air-operated pumping arrangement of claim 6, further including means for venting said bore to atmosphere.

8. The air-operated pumping arrangement of claim 7, further including spring means extending between said first poppet and said first valve chamber for resiliently biasing said first poppet upwardly to an open position.

9. The air-operated pumping arrangement of claim 8, further including displacement member means depending from said second poppet and extending downwardly into the tank for immersion in the fluid, whereby buoyant force from said displacement member is applied to said poppet valves to open said first poppet and close said second poppet when the fluid rises to a predetermined level.

10. The air-operated pumping arrangement of claim 9, wherein opening of said first poppet valve vents said first valve chamber and said second pressure line to atmosphere, and the loss of pressure in said second pressure line actuates said air operator to trigger said three port valve to deliver pressurized air through said first pressure line to said tank, whereby said pumping cycle is initiated.

11. The air-operated pumping arrangement of claim 10, wherein said first popper valve produces a pneumatic latching effect when closed to increase the buoyant force required to open said first poppet valve, and said second poppet valve produces a pneumatic latching effect when closed to increase the net weight of said displacement member required to open said second poppet valve.

12. The air-operated pumping arrangement of claim 1, wherein said quick exhaust valve means includes a valve body having opposed ends, a first bore extending in one end and a second bore extending in the opposed, second end, said first and second bores disposed generally coaxially.

13. The air-operated pumping arrangement of claim 12, wherein said second bore includes an annular inner portion defining a cylindrical projection extending coaxially into said second bore, said first bore extending coaxially in said cylindrical projection.

14. The air-operated pumping arrangement of claim 13, further including flow openings extending from said second bore through an inner end surface of said cylindrical projection to said first bore.

15. The air-operated pumping arrangement of claim 14, further including a tapped port extending from an exterior of said valve body to said annular portion of said second bore.

16. The air-operated pumping arrangement of claim 15, further including a valve element disposed in said second bore in axially translatable fashion and variably positionable to block or unblock said flow openings.

17. The air-operated pumping arrangement of claim 16, further including an end cap secured to said valve body and disposed to retain said valve element in said second bore, said end cap including a third bore extending generally coaxially with said first and second bores and in flow communication therewith.

18. The air-operated pumping arrangement of claim 17, wherein said valve element comprises a disc substantially similar in diameter to said end surface of said cylindrical projection.

19. The air-operated pumping arrangement of claim 18, wherein said disc includes an annular flange substantially similar in diameter to said second bore, said flange being resiliently deformable to permit airflow from said third bore past said flange to said tapped port.

20. The air-operated pumping arrangement of claim 1, further including check valve means for permitting inflow of liquid into the tank, and vacuum supply means connected to the tank for increasing the flow rate of liquid through said check valve means into the tank.

21. The air-operated pumping arrangement of claim 20, wherein said vacuum supply means is connected to a rapid exhaust port of said quick exhaust valve means.

22. The air-operated pumping arrangement of claim 21, wherein said vacuum supply means is further connected to a vent port of said air-operated valve means.

* * * * *